US012789322B2

(12) United States Patent
Champaigne et al.

(10) Patent No.: US 12,789,322 B2
(45) Date of Patent: Nov. 10, 2026

(54) DISTANCE AND ANGLE DETECTION FOR SHOT PEENING NOZZLES

(71) Applicant: Electronics, Inc., Mishawaka, IN (US)

(72) Inventors: Jack Champaigne, Mishawaka, IN (US); Kenneth Derucki, Mishawaka, IN (US); Bryan Chevrie, South Bend, IN (US)

(73) Assignee: Electronics, Inc., Mishawaka, IN (US)

( * ) Notice: Subject to any disclaimer, the term of this patent is extended or adjusted under 35 U.S.C. 154(b) by 382 days.

(21) Appl. No.: 18/662,514

(22) Filed: May 13, 2024

(65) Prior Publication Data

US 2024/0424640 A1 Dec. 26, 2024

Related U.S. Application Data

(60) Provisional application No. 63/509,796, filed on Jun. 23, 2023.

(51) Int. Cl.

| | |
|---|---|
| ***B24C 1/10*** | (2006.01) |
| ***B24C 5/04*** | (2006.01) |
| ***B24C 7/00*** | (2006.01) |

(52) U.S. Cl.

CPC ..... *B24C 7/00* (2013.01); *B24C 1/10* (2013.01); *B24C 5/04* (2013.01)

(58) Field of Classification Search

CPC ..... B24C 7/00; B24C 1/10; B24C 5/04
USPC ..... 700/245–264; 451/38, 89
See application file for complete search history.

(56) References Cited

U.S. PATENT DOCUMENTS

| | | | | |
|---|---|---|---|---|
| 2,146,723 | A | 2/1939 | Dunham | |
| 2,350,440 | A | 6/1944 | Almen | |
| 4,030,097 | A | 6/1977 | Gedeon | |
| 4,614,100 | A | 9/1986 | Green | |
| 4,873,855 | A | 10/1989 | Thompson | |
| 5,113,680 | A | 5/1992 | Matsuura | |
| 5,176,018 | A | 1/1993 | Thompson | |
| 5,212,976 | A | 5/1993 | Company | |
| 5,596,912 | A * | 1/1997 | Laurence | B24C 1/10 72/53 |
| 5,691,483 | A | 11/1997 | Linnemann | |

(Continued)

FOREIGN PATENT DOCUMENTS

WO 2012168190 A1 12/2012

OTHER PUBLICATIONS

Non-final Office Action from U.S. Appl. No. 18/166,827, dated Nov. 14, 2025, 15 pp.

(Continued)

*Primary Examiner* — Jaime Figueroa
(74) *Attorney, Agent, or Firm* — Greenberg Traurig, LLP

(57) ABSTRACT

An apparatus for accurately measuring the distance and angle between a shot media nozzle and target workpiece is provided. The apparatus may include a nozzle attachment comprising an attachment end and a front end, a sensor attached to the nozzle attachment, a controller comprising a processor with computer-readable instruction, and a visual display. The controller may accurately calculate the distance and angle the nozzle is offset from a target workpiece to which shot peening media is blasted by using distance and angle measurements provided by the sensor. The distance and angle calculations help provide consistent peening application.

17 Claims, 5 Drawing Sheets

(56) References Cited

U.S. PATENT DOCUMENTS 6,401,001 B1 * 6/2002 Jang ..... B29C 64/40 204/192.15
6,640,596 B2 11/2003 Yamamoto
7,703,312 B2 * 4/2010 David ..... F01D 5/3007 451/39
9,027,375 B2 * 5/2015 Hennig ..... B24B 39/006 239/690
9,718,166 B2 * 8/2017 Fujii ..... B24C 5/04
11,298,799 B2 * 4/2022 Brand ..... B24C 5/02
11,446,786 B2 * 9/2022 Kozaki ..... B64F 5/10
11,583,976 B2 * 2/2023 Krehbiel ..... B24C 3/02
11,679,454 B2 * 6/2023 Sanders ..... C21D 7/06 239/589
2003/0012978 A1 * 1/2003 Sodani ..... B24C 1/06 148/533
2008/0223099 A1 * 9/2008 David ..... F01D 5/3007 416/223 R
2010/0212157 A1 * 8/2010 Hennig ..... B24C 3/22 29/889.7
2011/0104991 A1 * 5/2011 O'Donoghue ..... B24C 1/10 451/36
2013/0263635 A1 * 10/2013 Barth ..... C21D 7/06 72/56
2015/0068262 A1 * 3/2015 Hennig ..... B24C 7/00 72/53
2015/0231762 A1 * 8/2015 Fujii ..... G21C 17/017 72/53
2019/0337120 A1 * 11/2019 Brand ..... B24C 5/02
2019/0337121 A1 * 11/2019 Cheng ..... B24C 7/0069
2019/0389035 A1 * 12/2019 Kozaki ..... B24C 3/32
2021/0046611 A1 * 2/2021 Ho ..... G01F 1/74
2024/0200159 A1 * 6/2024 Chen ..... B23P 15/14

OTHER PUBLICATIONS

International Search Report and Written Opinion of international application No. PCT/US24/15173, dated May 23, 2024, 10 pp.

* cited by examiner

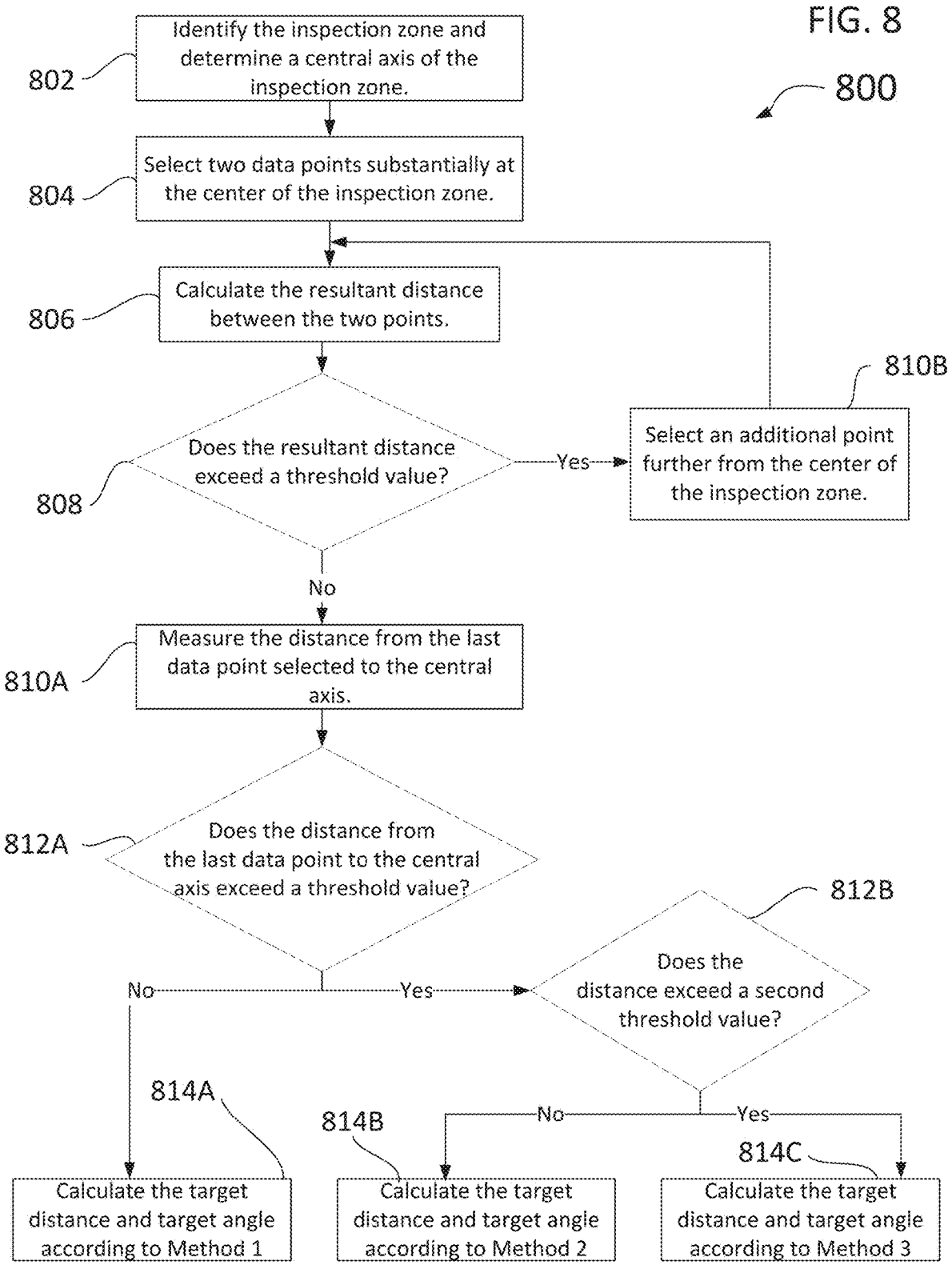
FIG. 8
800
802
Identify the inspection zone and determine a central axis of the inspection zone.
804
Select two data points substantially at the center of the inspection zone.
806
Calculate the resultant distance between the two points.
808
Does the resultant distance exceed a threshold value?
Yes
810B
Select an additional point further from the center of the inspection zone.
No
810A
Measure the distance from the last data point selected to the central axis.
812A
Does the distance from the last data point to the central axis exceed a threshold value?
No
Yes
812B
Does the distance exceed a second threshold value?
No
Yes
814A
Calculate the target distance and target angle according to Method 1
814B
Calculate the target distance and target angle according to Method 2
814C
Calculate the target distance and target angle according to Method 3

DISTANCE AND ANGLE DETECTION FOR SHOT PEENING NOZZLES

CROSS REFERENCE TO RELATED APPLICATION

This application is a non-provisional conversion of U.S. Pat. App. No. 63/509,796 entitled "DISTANCE AND ANGLE DETECTION FOR SHOT PEENING NOZZLES," filed Jun. 23, 2023, the contents of which are incorporated in their entirety and for all purposes.

TECHNICAL FIELD

This disclosure generally relates to shot peening, and specifically the detection of an offset distance and angle of the nozzle of a shot peening unit to a target.

BACKGROUND

Shot peening is a surface enhancement process that imparts a shallow layer of compressive residual stress into the surface of a metal component by impacting metallic, ceramic, or glass peening particles, otherwise referred to as shot or media, at a high velocity.

BRIEF DESCRIPTION OF THE DRAWINGS

FIG. 8 is a flow chart illustrating an example process for selecting between a first, second, or third method to calculate a target distance and a target angle.

DETAILED DESCRIPTION

Figure 1:
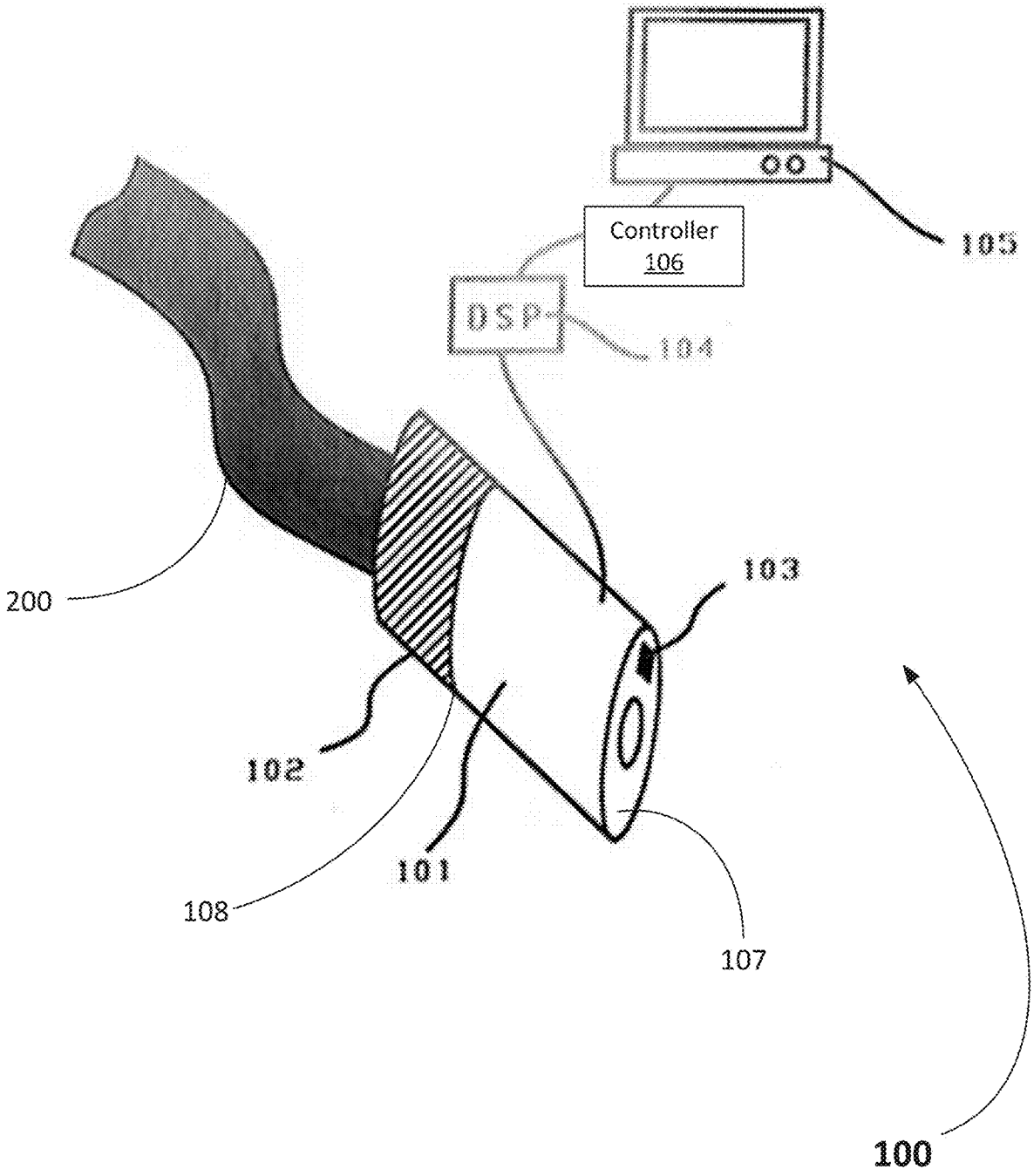
FIG. 1 illustrates an example system for determining a position of a target surface.

Shot peening is a surface enhancement process that imparts a shallow layer of compressive residual stress into the surface of a metal component by impacting metallic, ceramic, or glass peening particles, otherwise referred to as shot or media, at a high velocity. The intensity of peening is dependent upon the kinetic energy of the shot, which is a function of its mass and velocity. This velocity varies with various machine parameters, including the offset distance from the peening nozzle of the shot peening unit to the impingement target-a target object or the workpiece to which shot media is applied. Throughout a peening process, the nozzle of the shot peening unit may move across an impingement target, or an impingement target may move relative to the nozzle, such that the offset distance and angle of a specific area of the impingement target to which shot media is applied may vary relative to immediately adjacent areas as the surface geometry of the impingement target changes. Keeping this distance constant requires extensive control mechanisms, often utilizing robotic devices. Due to the complexity of these systems, the offset distance oftentimes can only be confirmed in between cycles.

The peening coverage must also be maintained with great accuracy throughout a peening process in order to comply with industry standards over peening coverage such as SAE J2277. A peening process must be designed in order to ensure this compliance, which is time-consuming and requires the use of complex equipment and a skilled operator. Many processes are completed with irregularly shaped targets which possess holes, edges, and steep faces. These features further complicate the design of the peening process, as the offset distance and angle from the nozzle to a particular region on the impingement target may change as the nozzle moves over the impingement target, or the impingement target is moved relative to the nozzle. In peening operations, it is beneficial to know the offset distance and angle from the nozzle of the shot peening unit to the target region or area of the impingement target to which shot media is directed.

Reference will now be made in detail to various embodiments, examples of which are illustrated in the accompanying drawings. While this disclosure includes certain examples, it will be understood the disclosure is not intended to limit the claims to these examples. On the contrary, the disclosure is intended to cover alternatives, modifications and equivalents, which may be included within the spirit and scope of the claims. Furthermore, in this detailed description, numerous specific details are set forth in order to provide a thorough understanding. However, one of ordinary skill in the art will appreciate that the subject matter of the present disclosure may be practiced without these specific details. In other instances, well known methods, procedures, and components have not been described in detail as not to unnecessarily obscure aspects of the present disclosure.

The instant disclosure includes a nozzle attachment that houses a proximity detection system for use in shot peening processes. This detection system may provide, to a user or controller, real-time distances (an "offset distance" or "distance") and incident angle relationships (an "angle") between the peening nozzle and a target surface. These data allow a peening process to be designed with more precision, ensuring proper and consistent peening coverage without requiring a peening operation to be shut down while external measurement equipment is used to validate the nozzle offset distance and angle from the impingement target.

Referring now to FIG. 1, an example system 100 for determining a position of a target surface is shown. The system 100 includes a nozzle attachment 101 configured to be mounted at the end of a shot peening nozzle 200. The nozzle attachment 101 further has a front end 107 and a connector end 108. In some examples, the nozzle attachment 101 may be integral, or the same component as the shot peening nozzle 200. In the example shown in FIG. 1, the nozzle attachment 101 includes a threaded nozzle insert 102 located substantially at the connector end 108 of the nozzle attachment 101 for easy installation in a shot peening arrangement. This nozzle attachment 101 may be constructed from a rigid, non-conductive material. The system 100 further includes a sensor 103 attached to or contained substantially within the front end 107 of the nozzle attachment 101. In some examples, the sensor 103 may be located elsewhere on the nozzle attachment 101, such as on the sides of the nozzle attachment 101, and still accomplish the same function of obtaining offset distance and angle data in much the same way.

Still in the example shown in FIG. 1, the sensor 103 is a light detection and ranging ("LIDAR") sensor or similar sensor suitable for measuring a distance between the sensor 103 and a target object. For example, LIDAR sensors operate by using light in the form of a pulsed laser to measure ranges, or variable distances, between the sensor and an object to which the sensor emitting the pulsed laser is pointed. The sensor measures the elapsed time between when the pulsed laser light is emitted from the sensor, and when the light returns to a receiver on the sensor. The speed of the pulsed laser light emitted from the sensor is known, and therefore the distance between the sensor and the object reflecting the laser light back to the sensor can be calculated using the time it takes the pulsed light to return to the sensor. The sensor may emit at least one, and in some instances many different pulses of light and aimed toward at least one, and in some instances many, different points in a defined area. The sensor, or a controller connected to the sensor, may average multiple times corresponding to the many different pulses of light emitted from the sensor to provide an average distance to a point in an area targeted by the sensor. The sensor, or a controller connected to the sensor, may average the many pulses of light emitted to the many different points in a defined area to provide an average distance to a target.

LIDAR sensors may be advantageous over other methods or instruments used to obtain similar measurements. For example, optical sensors, such as cameras, require being focused or adjusted not only for a target area but also for a target range of distance or depth, in order to achieve accurate measurements. Optical sensors and cameras may also become obscured by dust particles or other obstructions, which may reduce the sensor's accuracy or completely prohibit the optical sensor from functioning. LIDAR, however, emits waves which may not require focus for depth and may pass through dust particles or other obstructions, and may thus be advantageous for use in shot peening applications where dust and other debris may be present.

The sensor 103 communicates with a controller 106 via a digital signal processor 104 which, in this instance utilizes ethernet communication, USB communication, a digital signal processing program, a PCB control system, or any suitable communication protocol to establish a connection between the sensor 103 and the controller 106. The controller 106 communicates with a display 105 to display one or more datapoints generated by the sensor 103.

Figure 2:
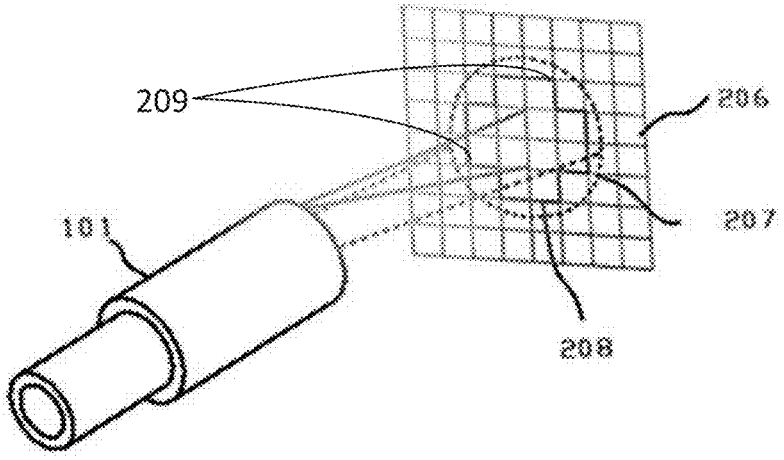
FIG. 2 illustrates the example system of FIG. 1 with an example target surface.

The sensor 103, attached to the nozzle attachment 101, defines a detection zone 206, as shown in FIG. 2. In an example, a LIDAR sensor may emit many pulses of laser light directed to at least one, and in some instances many points in a defined area to which the sensor is pointed. The area to which the sensor may emit light is defined as a detection zone 206. This detection zone 206 is defined as an effective range for the sensor 103 (e.g., area in which the sensor 103 is capable of sensing objects), and includes a peening zone 207, which is itself defined as a circular target area in which the shot media is expected to disperse. In an example, the detection zone 206 of the sensor may be centered on the peening zone 207, such that their centers are aligned. The shape, size, and orientation of the peening zone 207 is based on the distance between the nozzle 200 and an impingement target (e.g., target 309). From within the peening zone 207, an array of points 209 is selected to further define an inspection zone 208. The array of points 209 may be selected automatically by the sensor 103, automatically by the controller 106, and/or by a user utilizing the display 105 (e.g., the user's inputs on the display 105 may be converted by the display 105 or a processor coupled to the display 105 into commands for the controller 106 and/or sensor 103). The array of points 209 may be selected in order to maximize an amount of overlap between the inspection zone 208 and the peening zone 207, such that as much of the peening zone 207 is included within the inspection zone 208 as possible.

The array of points 209 may be selected automatically by the sensor 103, automatically by the controller 106, and/or by a user utilizing the display 105 to be a grid of points spaced in a planar direction (having a vertical and horizontal spacing) that is substantially normal to the direction of the pulsed laser light emitted by the sensor 103. In an example, the array of points 209 may be selected automatically by the sensor 103, automatically by the controller 106, and/or by a user utilizing the display 105 to be an 8×8 grid of points, or array of points 209 representing the inspection zone 208. In an example, the array of points 209 may be centered about the detection zone 206 of the sensor 103, which may be centered about the peening zone 207.

Figure 3:
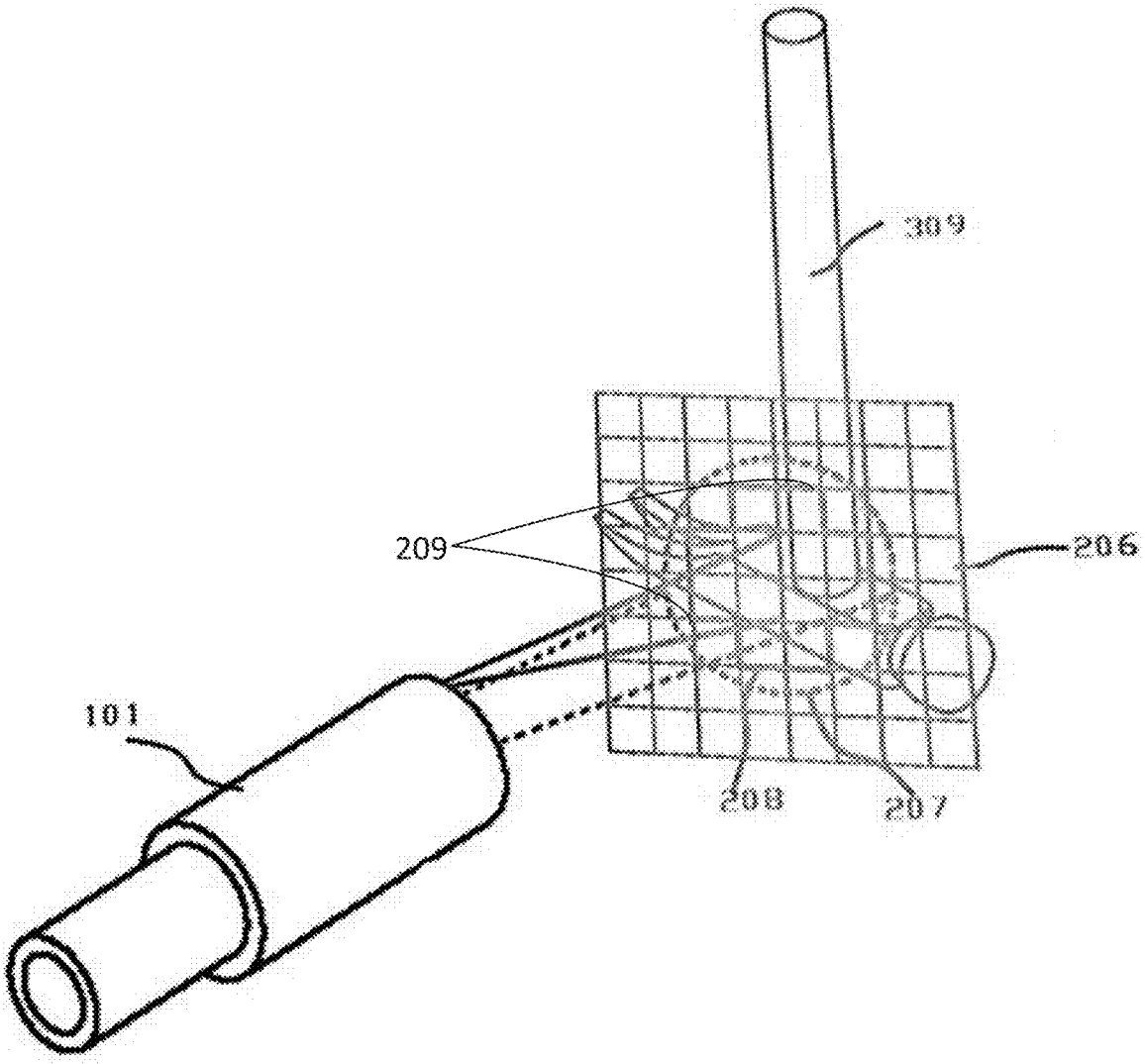
FIG. 3 illustrates the example system of FIG. 1 with an example target surface.

As shown in FIG. 3, a target 309 is placed within the inspection zone 208. The target 309 may be an impingement target, or any other surface for which shot peening is desired, and in this example is shown in FIG. 3 to be a hammer. For each of the points 209 in the inspection zone 208, represented by the cross in FIG. 3, the system, in particular the controller 106 measures or calculates an offset distance in order to create a geometric model of the target 309.

Figure 4:
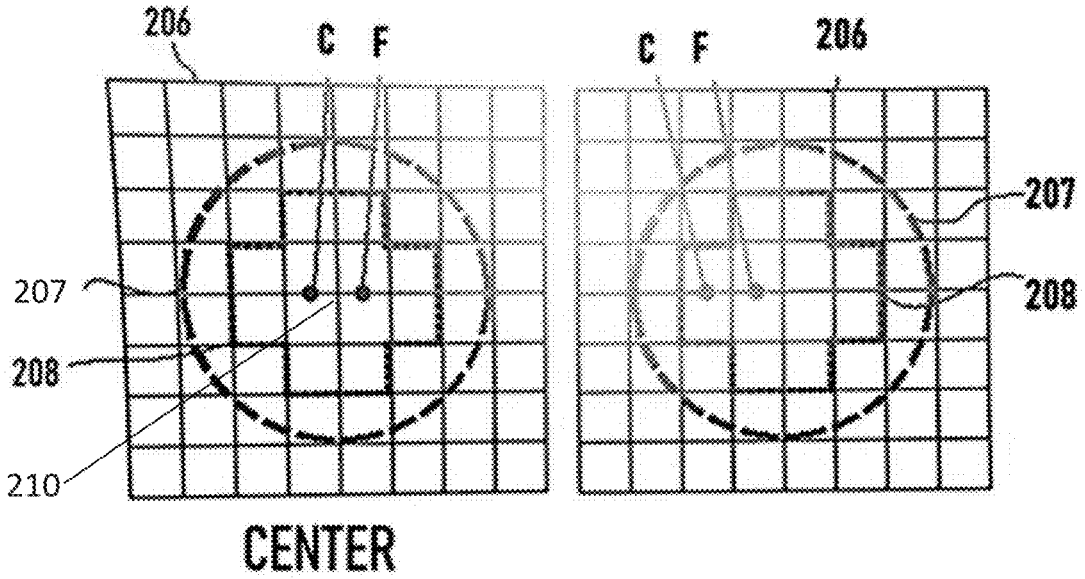
FIG. 4 illustrates a chart of point selection utilized by the example system of FIG. 1.

In one example, the controller 106 selects two points C and F substantially in the center of the inspection zone 208, as shown in FIG. 4. In one example, if the two points C and F lie on or around a detected edge, such that one point is located on either side of the detected edge, the controller 106 selects an additional point in the inspection zone 208 such that the additional point and at least one of the first two points do not lie on a detected edge. In one example, if the two points lie on or around a detected edge, the controller selects two alternative points chosen from the oblique view, which centers on either the left, right, upward, or downward leg of the inspection zone 208. The system 100 determines whether the selected points lie on or around a detected edge by first determining a position(s) of one or more edges within the inspection zone 208.

In one example, to determine if the two points lie on a detected edge, the controller 106 determines the distance between the sensor 103 and a first point, and then determines the distance between the sensor 103 and a second point. The controller 106 calculates the change in distance between the first and second points, or the delta, and compares that value against a threshold value to determine if an edge is present. The system 100 (and, particularly, the controller 106) employs an algorithm that identifies edges based on a comparison of the distances from the sensor 103 to adjacent points within the inspection zone 208. In response to the difference in distances being greater than a threshold value, the system 100 determines that an edge is present between the two adjacent points.

In an example, if the system 100 by an algorithm determines that an edge is present between the two adjacent points, the system 100, and in particular the sensor 103 may be refocused to focus the detection zone 206 and thus the inspection zone 208 on a different area of the peening zone 207, such that the edge is not present in, or is on the outermost part of the detection zone 206 and/or inspection zone 208. In an example, if the system 100 by an algorithm determines that an edge is present between the two adjacent points, the system 100, and particularly the controller 106 directs the sensor 103 to refocus the detection zone 206 and thus the inspection zone 208 on a different area of the peening zone 207. In an example, if the system 100 by an algorithm determines that an edge is present between the two adjacent points, the system 100, and particularly the controller 106 directs the algorithm to move the inspection zone 208 within the detection zone 206, but still within an area of the peening zone 207.

In an example, if the system 100 by an algorithm determines that an edge is present between the two adjacent points, the system 100, and in particular the shot peening nozzle 200 may be repositioned, or the controller 106 may direct the nozzle 200 to be repositioned, such that the sensor 103, detection zone 206, inspection zone 208 and the peening zone 207 are all repositioned to a different area on the target 309. In an example, if the system 100 by an algorithm determines that an edge is present between the two adjacent points, the target 309 may be repositioned within the peening zone 207.

In some examples, similar edge detection concepts are utilized in order to detect the presence of an object, or impingement target 309, in the inspection zone 208. In one example, rather than determining a scalar value for the distance between the sensor 103 and the point of detection, the controller 106 compares the distance itself to a threshold value, and translates the distance into a binary variable (e.g., within the threshold, without the threshold). By translating the distance determination into a binary variable and then plotting the variables on the inspection zone 208, the controller 106 maps a relative shape of the object.

Figure 5:
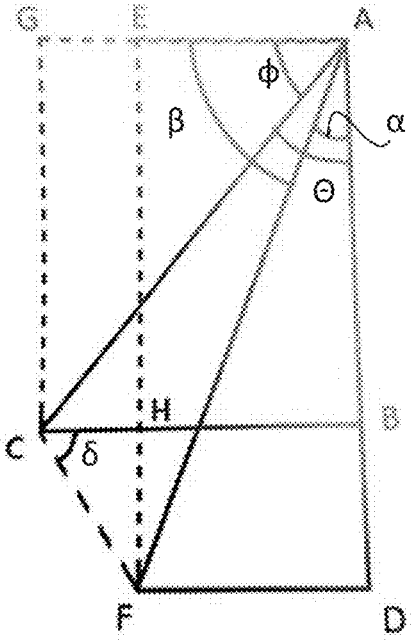
FIG. 5 illustrates a first method utilized by the example system of FIG. 1.
Figure 6:
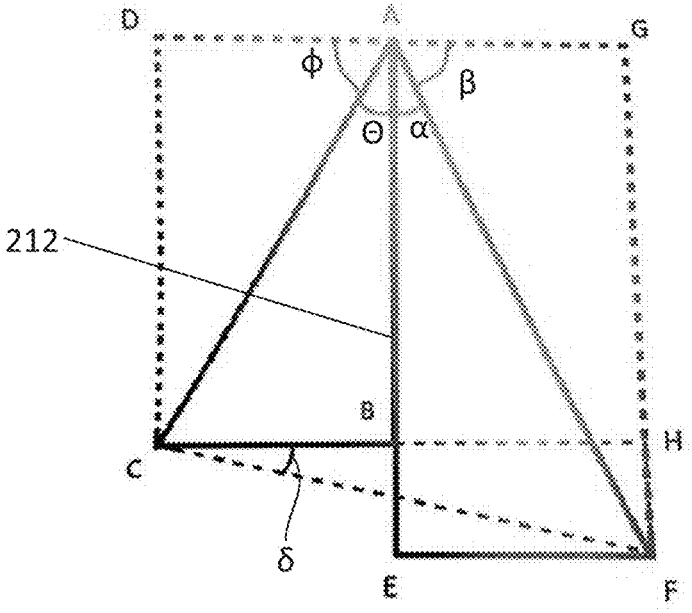
FIG. 6 illustrates a second method utilized by the example system of FIG. 1.

As shown in FIGS. 4-6, using points C and F, and determined distances from the sensor 103 to each of points C and F (respectively given as AC and AF) and determined angles (relative to X- and Y-axes) of the points C and F (respectively given as θ and α), the controller 106 utilizes at least one of three methods to determine the incident angle of the impingement target 309. A visual model of Method 1 is detailed in FIG. 5; and a visual model for Methods 2 and 3 is detailed in FIG. 6.

Referring now to FIG. 5, Method 1 includes the controller 106 using the length AC and the angle θ to determine the angle q, which is an angle between point C and the X-axis. From these values, the controller 106 calculates lengths CG and AG, where G is the position along the X-axis to which point C corresponds. By congruency, AG and CB are equal, and the same applies to CG and AB. Utilizing the length AF and the angle α, the controller 106 determines the angle β, which the controller 106 then utilizes to determine lengths AE and EF. By congruency, AE and FD are equal, and the same applies to EF and AD. From there, the controller 106 determines length HF according to:

$$\overline{HF} = \overline{AD} - \overline{AB}$$

The controller 106 determines length HC according to:

$$\overline{HC} = \overline{AB}\tan(\theta) - \overline{AD}\tan(\alpha)$$

Finally, the controller 106 determines angle δ, which defines an angle from C to F relative to the X-axis, according to:

$$\delta = \tan^{-1}\left(\overline{HF}/\overline{HC}\right)$$

Referring now to FIG. 6, Method 2 includes the controller 106 using the length AC and the angle θ to determine the angle φ, which is an angle between point C and the X-axis. From these values, the controller 106 calculates lengths CD and AD, where D is the position along the X-axis to which point C corresponds. By congruency, AD and CB are equal, and the same applies to CD and AB. Utilizing the length AF and the angle α, the controller 106 determines the angle β, which the controller 106 then utilizes to determine lengths AG and GF. By congruency, AG and EF are equal, and the same applies to AE and GF. From there, the controller 106 determines length CH according to:

$$\overline{CH} = \overline{AF}\sin(\alpha) + \overline{AC}\sin(\theta)$$

The controller 106 determines length HF according to:

$$\overline{HF} = \overline{AF}\cos(\alpha) - \overline{AC}\cos(\theta)$$

Finally, the controller 106 determines angle δ, which defines an angle from C to F relative to the X-axis, according to:

$$\delta = \tan^{-1}\left(\overline{HF}/\overline{HC}\right)$$

Method 3 utilizes the same initial steps as Method 2, but utilizes different formulas for determining the lengths CH and HF. In particular, the controller determines length CH according to:

$$\overline{CH} = \overline{AF}\tan(\alpha) + \overline{AC}\tan(\theta)$$

The controller 106 determines length HF according to:

$$\overline{HF} = \overline{AF} - \overline{AC}$$

The controller 106 then utilizes the same formula as Method 2 for angle δ.

In one example, the controller 106 utilizes Method 1 in response to determining that points C and F are substantially in a relative center 210 of the inspection zone 208, or if points C and F are on the same relative side of a central axis 212 (shown as line ABE in FIG. 6) of the inspection zone 208. In one example, the controller 106 utilizes Method 2 in response to determining that points C and F are close to (e.g., within a threshold distance of) the center of the inspection zone 208, or if points C and F are on opposite sides of the central axis 212 with an angle between points C and F (e.g., a sum of angle θ and angle α) equal to 45°.

Figure 7:
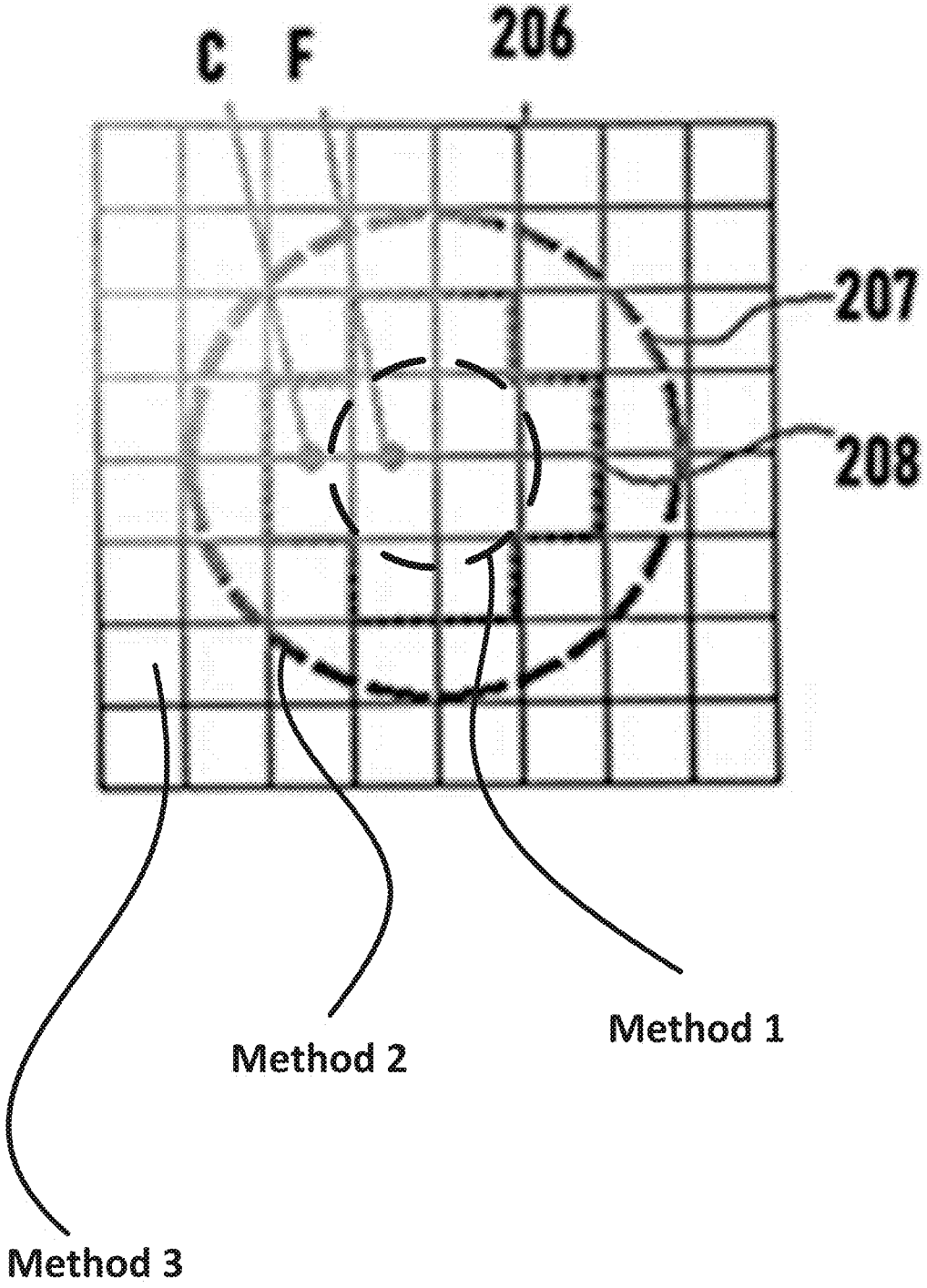
FIG. 7 illustrates a chart of calculation method selection utilized by the example system of FIG. 1.

Shown in FIG. 7, if the inspection zone 208 defines a plurality of points on a grid, in other words the array of points 209 selected from within the inspection zone 208, the controller 106 utilizes Method 2 if points C and F are one unit of measurement (on the defined grid) from a center point of the grid. In one example, the controller 106 utilizes Method 3 in response to determining that the points C and F are greater than a threshold distance from a center of the inspection zone 208. The controller 106 may prioritize Method 1 over Method 2, and Method 2 over Method 3.

FIG. 8 illustrates an example process map 800 for selecting a Method to calculate a distance and angle to an impingement target. At step 802, a controller identifies an inspection zone from data points provided by a sensor and determines a central axis of the inspection zone. At step 804, the controller then selects two data points which are substantially at the center of the inspection zone, in other words surrounding the central axis. At step 806, the controller calculates a resultant distance between the two data points, and at step 808, determines if the data points are on an edge of an example impingement target (if the resultant distance between the two points exceeds a threshold value).

If the resultant distance does exceed a threshold value, the controller goes to step 810B, in which the controller selects an additional data point at a predetermined additional distance away from the central axis. The controller repeats steps 806-810B until the resultant distance does not exceed the threshold value. When the resultant distance does not exceed a threshold, the controller at step 810A measures the distance from the last data point taken to the central axis. At step 812A, if the distance is below a first threshold value, the controller goes to step 814A and calculates the target distance and angle according to a first stored algorithm. If at step 812A the distance is above a threshold value, the controller goes to step 812B to determine if the distance is below or above a second threshold value. If the distance is below a second threshold value, the controller goes to step 814B and calculates the target distance and angle according to a second stored algorithm, but if the distance is above a second threshold value, the controller goes to step 814C and calculates the target distance and angle according to a third stored algorithm.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus for use in shot peening, comprising:

a nozzle attachment configured to fasten to a shot peening nozzle;

a sensor fastened to the nozzle attachment, the sensor to detect and transmit sensor data in an electronic signal, the sensor data further comprising a plurality of distances from the sensor to a plurality of points within an inspection zone; and a controller to receive the electronic signal, the controller further comprising:

a processor configured to execute computer instructions stored in a memory that when executed cause the controller to perform operations comprising:

identifying the inspection zone from the sensor data;

defining a central axis within the inspection zone;

identifying a first data point being a first distance from the sensor to a target object within the inspection zone relative to the central axis of the inspection zone;

identifying a second data point being a second distance from the sensor to the target object relative to the central axis of the inspection zone;

calculating a resultant distance between the first data point and the second data point; and comparing the resultant distance to a threshold value;

in response to the resultant distance being less than the threshold value, calculating a target distance and a target angle between the target object and a shot media exit point according to a stored algorithm.

2. The apparatus of claim 1, wherein the stored algorithm calculates the target distance and the target angle from a known distance and a known angle by using a trigonometric relationship between the known distance and the known angle and the target distance and the target angle.

3. The apparatus of claim 1, wherein the first data point is an N data point, the second data point is an N+1 data point, the stored algorithm is a first algorithm, and the controller, in response to the resultant distance exceeding the threshold value, performs additional operations comprising:

identifying a first additional N+1 data point;

calculating a first additional resultant distance between the N+1 data point and the first additional N+1 data point;

comparing the first additional resultant distance to the threshold value;

repeating the additional operations until an N+1 additional resultant distance does not exceed the threshold value;

calculating a final distance between a last additional N+1 data point and the central axis within the inspection zone;

comparing the final distance to a final distance threshold value;

in response to the final distance being less than the final distance threshold value, calculating the target distance and the target angle between the target object and the shot media exit point according to a second algorithm; and in response to the final distance exceeding the final distance threshold value, calculating the target distance and the target angle between the target object and the shot media exit point according to a third algorithm.

4. The apparatus of claim 1, wherein the sensor further detects the target object substantially in front of the sensor by detecting a plurality of points on a surface of the target object.

5. The apparatus of claim 4, wherein the controller further stores the plurality of points on the surface of the target object on the memory.

6. The apparatus of claim 5, wherein the apparatus further comprises:

a visual output display that further displays a shape of the target object using the plurality of points on the surface of the target object stored on the memory;

wherein the target distance and the target angle for a point on the target object are displayed on the visual output display.

7. The apparatus of claim 1, wherein the apparatus further comprises:

a nozzle control unit that changes a position of the shot peening nozzle with respect to the target object;

wherein the nozzle control unit changes the position of the shot peening nozzle in response to the target distance and the target angle calculated by the controller.

8. An apparatus for use in shot peening, comprising:

a nozzle attachment configured to fasten to a shot peening nozzle, the nozzle attachment further comprising:

a connector end;

a nozzle insert that attaches the connector end of the nozzle attachment to the shot peening nozzle; and a front end;

a sensor fastened to the front end of the nozzle attachment, the sensor to detect and transmit data in an electronic signal, the data further comprising:

an inspection zone;

a plurality of points on a target object within the inspection zone; and a plurality of distance and angle measurements between the sensor and points on the target object within the inspection zone;

a controller to receive the electronic signal, the controller further comprising a processor configured to execute computer instructions stored in a memory that when executed cause the controller to perform operations comprising:

identifying the inspection zone of the data transmitted from the sensor;

determining a central axis of the inspection zone;

defining a first threshold distance from the central axis of the inspection zone;

defining a second threshold distance from the central axis of the inspection zone, the second threshold distance being greater than the first threshold distance;

identifying a first data point corresponding to a first distance and angle measurement from the sensor to the target object within the inspection zone;

calculating a first off-center distance from the first data point to the central axis of the inspection zone;

identifying a second data point corresponding to a second distance and angle measurement from the sensor to the target object within the inspection zone;

calculating a second off-center distance from the second data point to the central axis of the inspection zone;

wherein:

in response to both the first and second off-center distances being below the first threshold distance, the controller calculates a target distance and a target angle from a shot media exit point to the target object according to a first algorithm, in response to both the first and second off-center distances being below the second threshold distance but at least one of the first and second off-center distances exceeding the first threshold distance, the controller calculates the target distance and the target angle according to a second algorithm, and in response to either the first or second off-center distances exceeding the second threshold distance, the controller calculates the target distance and the target angle according to a third algorithm.

9. The apparatus of claim 8, wherein:

the first algorithm calculates the target distance and the target angle from a known distance and a known angle by using a first trigonometric relationship between the known distance and known angle and the target distance and the target angle;

the second algorithm calculates the target distance and the target angle from a known distance and a known angle by using a second trigonometric relationship between the known distance and known angle and the target distance and the target angle;

the third algorithm calculates the target distance and the target angle from a known distance and a known angle by using a third trigonometric relationship between the known distance and known angle and the target distance and the target angle.

10. The apparatus of claim 8, wherein the sensor further detects the target object substantially in front of the sensor by a plurality of points on a surface of the target object.

11. The apparatus of claim 10, wherein the apparatus further comprises a computer readable memory; and the controller further stores the plurality of points on a surface of the target object on the computer readable memory.

12. The apparatus of claim 11, wherein the apparatus further comprises:

a visual output display that further displays a shape of the target object using the plurality of points on a surface of the target object stored on the computer readable memory;

wherein the target distance and the target angle for a point on the target object are displayed on the visual output display.

13. The apparatus of claim 8, wherein the apparatus further comprises:

a nozzle control unit that changes a position of the shot peening nozzle with respect to the target object;

wherein the nozzle control unit changes the position of the shot peening nozzle in response to the target distance and the target angle calculated by the controller.

14. A method for determining a position and orientation of a surface for shot peening, comprising:

detecting a plurality of points on a target object with a sensor positioned on a nozzle of a shot peening device;

determining, by the sensor, a distance between each of the plurality of points and the nozzle of the shot peening device;

determining, by the sensor, an angle defined by the determined distance for each of the plurality of points; and determining, by a controller, a distance and an angle of the nozzle relative to the target object based on the determined distances and the determined angles.

15. The method of claim 14, further comprising:

storing, by the controller, the distance between each of the plurality of points and the nozzle of the shot peening device, on a computer readable medium.

16. The method of claim 15, further comprising:

displaying, by a visual display, the distance between each of the plurality of points and the nozzle of the shot peening device in a graphical user interface.

17. The method of claim 14, further comprising:

controlling, by a nozzle control unit, the position of the nozzle in response to the distance and the angle of the nozzle relative to the target object based on the determined distances and the determined angles.

* * * * *